United States Patent [19]

Molaine et al.

[11] Patent Number: 4,818,962

[45] Date of Patent: Apr. 4, 1989

[54] WAVEGUIDE OBTAINED BY SELECTIVE ETCHING METHOD

[75] Inventors: André Molaine, Monthery; Jean Poitevin, Villejuif, both of France

[73] Assignee: Thomson-CSF, Paris, France

[21] Appl. No.: 900,483

[22] Filed: Aug. 26, 1986

[30] Foreign Application Priority Data

Sep. 3, 1985 [FR] France ..... 85 13088

[51] Int. Cl.[4] ..... H01P 3/12; H01P 3/123

[52] U.S. Cl. ..... 333/239; 29/600; 29/DIG. 16; 156/666

[58] Field of Search ..... 333/239, 248; 428/600, 428/601, 573–575; 29/600, DIG. 16; 156/666; 76/24 C

[56] References Cited

U.S. PATENT DOCUMENTS

| | | | |
|---|---|---|---|
| 1,434,798 | 11/1922 | Stafford | 156/666 X |
| 1,915,084 | 6/1933 | Bonsall | 428/600 X |
| 2,488,510 | 11/1949 | Lewin | 428/600 |
| 3,013,267 | 12/1961 | Rotman | 333/239 X |
| 3,287,191 | 11/1966 | Borth | 156/666 X |
| 3,508,108 | 4/1970 | Salisbury . | |
| 3,956,814 | 5/1976 | Peet | 29/DIG. 16 X |
| 4,206,536 | 6/1980 | Hammond et al. | 428/573 X |
| 4,422,465 | 12/1983 | Haga | 76/24 C X |
| 4,456,500 | 6/1984 | Ibata | 428/573 X |

FOREIGN PATENT DOCUMENTS

| | | |
|---|---|---|
| 1372849 | 11/1974 | United Kingdom . |
| 2110165 | 6/1983 | United Kingdom . |

OTHER PUBLICATIONS

Patents Abstracts of Japan, vol. 8, No. 212 (C-244) [1649], Sep. 27, 1984, JP A 59-96276.

*Primary Examiner*—Paul Gensler

*Attorney, Agent, or Firm*—Pollock, VandeSande & Priddy

[57] ABSTRACT

The invention provides mainly a selective etching method for the total or partial chemical ablation at certain positions of a metal sheet, and a waveguide obtained by said method. Complete ablation is obtained by etching both faces of the metal sheet. Partial ablation is obtained by etching only one of the faces of the metal sheet. Partial ablation allows grooves and semi-thicknesses to be obtained for forming bends and rabbets for the formation of three dimensional pieces.

3 Claims, 2 Drawing Sheets

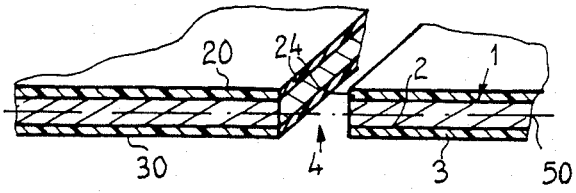
FIG_1
PRIOR ART
FIG_2
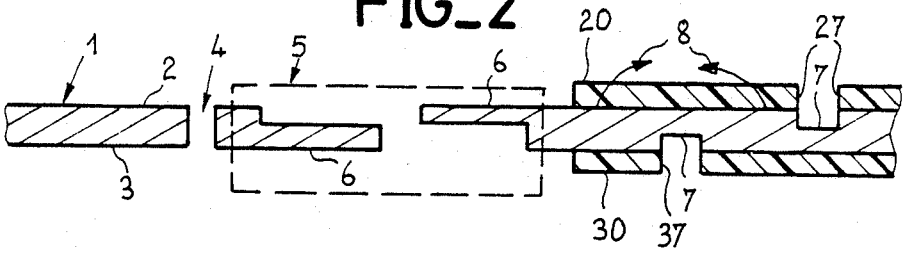
FIG_3
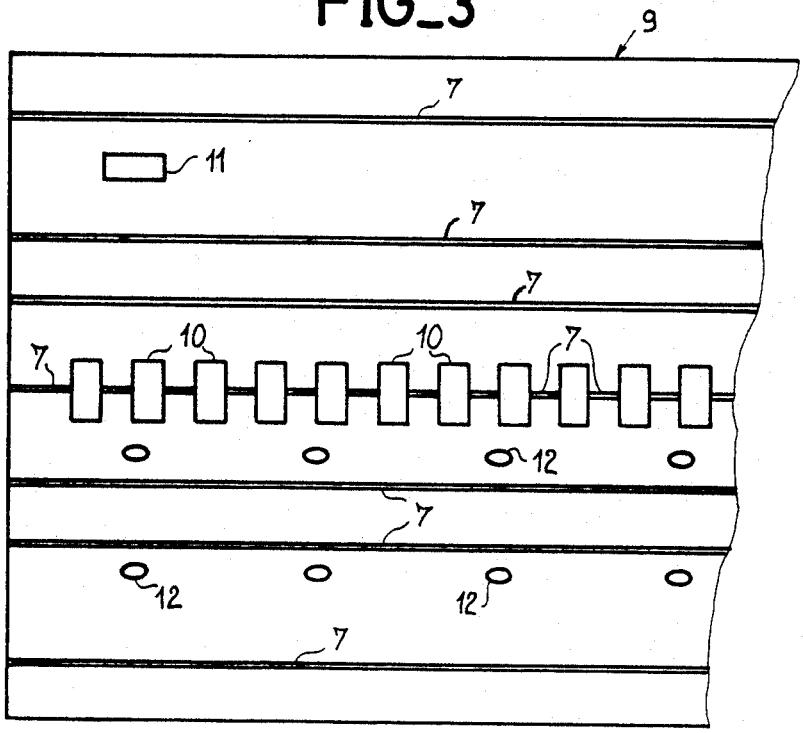

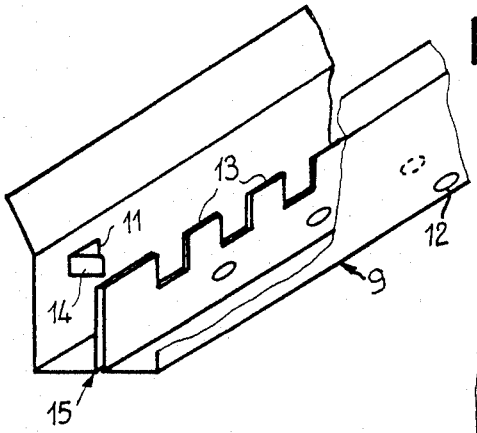
FIG_4
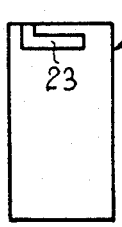
FIG_6
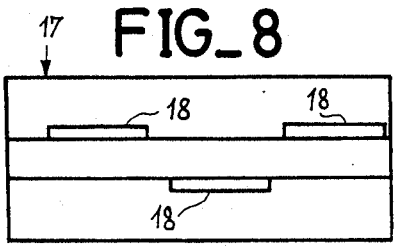
FIG_8
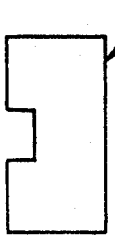
FIG_9
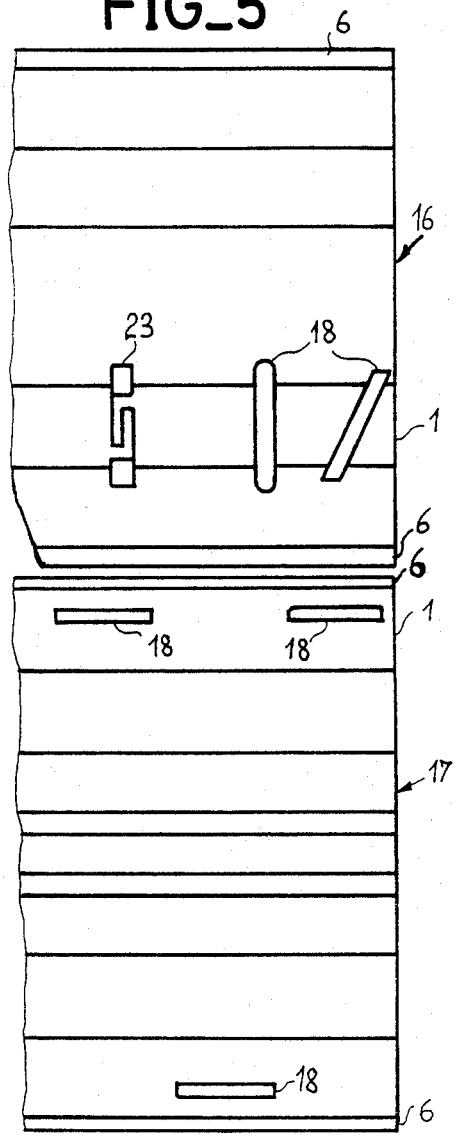
FIG_5
FIG_7

WAVEGUIDE OBTAINED BY SELECTIVE ETCHING METHOD

BACKGROUND OF THE INVENTION

The invention is a method of selective etching and a waveguide produced by said method.

The chemical cutting of metal pieces is known. Chemical cutting consists in the ablation of certain parts of a piece of metal by chemical etching. The piece of metal may be a copper sheet. The chemical reagent may be sulfuric acid, nitric acid, iron perchloride. Chemical cutting has the advantage of inducing no stress in the piece cut as opposed to mechanical machining. In addition, every cut is made during a single pass in the chemical cutting machine independently of the complexity of the pattern.

The sheet to be cut out is itself protected by a layer chemically insensitive to the reagent. The protective layer is absent only above the parts of the sheet to be ablated.

Chemical cutting has the great drawback of only allowing flat pieces to be produced.

The method of the present invention provides chemical etching of a metal sheet ensuring local reduction of the thickness of the metal. For example, half of the thickness of the sheet is removed locally. Thus, grooves may be formed for very accurate bending of the sheet. Furthermore, by locally removing half of the thickness of the metal sheet, it is possible to form a rabbet for closing a developable volume from a flat sheet. The rabbet also allows large dimensioned objects to be formed by assembling together sheets of smaller size. Thus the method of the invention is applied to the construction of waveguides, particularly trough guides or comb guides as well as features to locally perturb an electromagnetic field.

The principal object of the invention is a method for the chemical ablation of material from a metal sheet covered on both its faces with a protective film comprising patterns symmetrical with respect to the plane of the sheet leaving the sheet bare at desired positions, said protective films further comprising patterns leaving the metal sheet bare on one of its faces, the other face of the sheet being protected at this position by the protective film.

BRIEF DESCRIPTION OF THE DRAWINGS

The invention will be better understood from the following description and accompanying figures given by a way of non limitative examples in which:

FIG. 1 illustrates the chemical cutting out method;

FIG. 2 illustrates the selective etching method of the invention;

FIGS. 3, 5 and 7 show 3 examples of selectively etched metal sheets;

FIGS. 4, 6, 8 and 9, illustrate the waveguides obtained from the sheets FIGS. 3, 5 and 7.

In FIGS. 1 to 9, the same references are used for designating the same parts.

DESCRIPTION OF THE PREFERRED EMBODIMENT

In FIG. 1, a metal sheet 1 is shown, having an opening 4 formed by chemical cutting out. The metal sheet 1 bisected by plane 50, made for example from copper or bronze, is cleaned on both its faces 2 and 3. On the cleaned faces 2 and 3 a photosensitive film 20 and 30 is deposited for example by hot lamination. The photosensitive films 20 and 30 are for example a film sold by the firm Dupont de Nemours SA under the Trademark RISTON. The masks of the pattern to be cut out are applied to the sheet. Vacuum application is often used for accurately positioning the mask. The photosensitive films are irradiated for example with ultraviolet radiation. The ultraviolet irradiation is carried out either continuously for large scale production or chassis by chassis. The metal sheet 1, covered on both of its faces 2 and 3 with irradiated photosensitive films 20 and 30, is developed in a developer. The developer is adapted to the photosensitive film used. Solvent developer or basic solution developer can be used. The non irradiated parts of the photosensitive film are dissolved by the developer. The metal sheet is then chemically etched, for example using iron perchloride. The iron perchloride is for example sprayed on both faces of sheet 1. Only the uncovered parts of the protective layer formed by the films 20 and 30 are etched. With the chemical etching finished, the photosensitive layer is removed. In FIG. 2, the left hand part of the sheet omits films 20 and 30.

Elimination of the photosensitive layers may be followed by cleaning of the sheet, for example, by brushing.

In FIG. 2 a metal sheet 1 is shown which is selectively etched in accordance with the invention. In addition to the cut outs formed in the prior art, grooves 7 may be formed as well as ablations over, for example half the thickness of sheet 1. The parts 6 of sheet 1 having undergone ablation of half of their thickness allow rabbets 5 to be formed for assembling together several sheets and/or the two ends of the same sheet. The two parts 6 of sheet 1 are either welded or bonded together with a conducting bonding agent. Groove 7 allows sheet 1 to be bent for example in the direction of arrows 8. The accuracy of bending is also that of the groove. In addition, there is no stress induced in sheet 1 during selective etching in accordance with the invention. Thus, the bending stresses are not influenced therein by prior stresses undergone by the sheet. The use of copper or copper alloy sheets 1 comprising multiple grooves 7 allows very low bending forces to be used. Thus, bending may be obtained with reduced tooling, the edge of the bend being for example obtained by aluminium bars.

The accuracy of the selective etching is principally limited by the dimensional variations of the photosensitive films or of the masks. Since these variations are constant for a given film batch, it is advantageous to compensate for dimensional variations by forming masks whose pattern allows the desired pattern to be obtained on the photosensitive films after development. The compensations to be made are indicated by the manufacturers of photosensitive films.

Chemical cutting out as well as the formation of grooves 7 and of thickness reduction (allowing rabbets to be formed) are obtained in a single pass by the selective etching of the invention. A variation of thickness may be achieved by a second selective etching by covering with protective films 20 and 30, the parts which are not to be etched. For local ablations, the metal of sheet 1 whose thickness must be reduced by 50%, a second pass is made in the machine.

During the second pass (as was true during the first pass), the protective films 20 or 30 are absent from the position having to undergo ablation. The depth of the ablation is a linear function of the time of the chemical etching undergone by the sheet. Futhermore, it is possible by a selective etching, to obtain very fine metal sheets with the desired shapes and elasticity.

FIG. 3 shows one example of selective etching of a copper sheet for forming an electronic scan antenna useful as a radiating source. The sheet, intended to form source 9, comprises total cut outs (or openings) 10 and 12 and half thickness grooves 7. Grooves 7 allow the copper sheet to be folded so as to form the radiation source. The total cut outs allow desired openings 12 to be formed as well as a central comb for modifying the electromagnetic properties of source 9. Furthermore, by the total cutting out at 11 on three sides of a part of source 9, associated with a groove 7 on a fourth side, a piece 14 may be obtained, as shown in FIG. 4, bent for example inwardly of the source. The bent element 14 locally perturbs an electromagnetic field.

In FIG. 4, a perspective view is shown of the radiation source 9 formed from the sheet of FIG. 3. During assembly it is advantageous to weld or bond with a conducting bonding agent, the two halves forming the central ridge 15. Advantageously, the conducting bonding agent is deposited on the two halves of the central ridge 15 before folding of the radiating source 9.

The spacing of the height of the teeth 13 of source 9 is not necessarily constant. It is determined so as to obtain desired electromagnetic characteristics for source 9. With the method of the invention, very light three dimensional high precision pieces may be obtained without having recourse to very expensive machining especially for complicated pieces. However, all the cutting out and the etching of the grooves are accomplished on the sheet before any bending.

FIGS. 5 and 7 show the sheets 1 intended to form waveguides respectively 16 and 17. Waveguides 16 and 17 comprise cut outs 18 forming radiating slits. Waveguide 16 further comprises a cut out for introducing into the waveguide bent feature 23 for locally perturbing an electromagnetic field.

In FIG. 6, a rectangular waveguide 16 can be seen formed from the sheets shown in FIG. 5. Closure of the guide is obtained by bonding or welding the rabbet, the use of the region of sheet 1 comprising half thicknesses 6 means that the thickness of the walls of the guide at the position of the assembly is not modified and the electromagnetic qualities of the guide are not disturbed.

FIG. 8 shows a waveguide 17 with a ridge and having three radiating slits 18.

FIG. 9 shows the waveguide 17 in section.

Other metal sheet selective etching variants do not depart from the scope of the present invention. For example, the depth of the ablation is obtained by a variation in time of the chemical etching or by concentration of the reagents used. For example, different concentrations may be used for etching the faces 2 or 3 of a sheet 1.

In another variant, the mask for forming the patterns is projected through a lens and not applied to the photosensitive films.

In a third variant, the films 20 and 30 providing protection of sheet 1 at the positions which do not have to undergo ablation are deposited directly. Wax may for example be used.

The invention is not limited to etching of the copper metal sheet 1. Ferrous metal sheets may be used for example by adapting the choice of concentration of the reagents as well as the reaction time to the metal and to the thickness of the etched sheet 1.

The invention applies mainly to the formation of three dimensional pieces from metal sheets.

The invention applies particularly to the construction of waveguides and radioelectric radiation sources.

The invention also applies to the construction of large dimensioned metal pieces assembled from selectively etched sheets of smaller size.

What is claimed is:

1. A waveguide formed from a metal sheet, said waveguide including stress-free cutouts and ablations formed by chemical etching and having at least one bent portion, bent along a region of reduced thickness, said region of reduced thickness formed by chemical ablation.

2. A waveguide as recited in claim 1 which further includes a rabbet assembly region having an overlying and underlying portion, both said overlying and underlying portions comprising regions of reduced thickness formed by chemical ablation.

3. A trough waveguide as recited in claim 1 or claim 2 further including a central comb.

* * * * *